US005295355A

United States Patent [19]

Zhou et al.

[11] Patent Number: 5,295,355

[45] Date of Patent: Mar. 22, 1994

[54] MULTI-BYPASS PULSE TUBE REFRIGERATOR

[75] Inventors: Yuan Zhou; Junjie Wang; Wenxiu Zhu; Jinghui Cai, all of Beijing, China

[73] Assignee: Cryogenic Laboratory of Chinese Academy of Sciences, Beijing, China

[21] Appl. No.: 998,806

[22] Filed: Dec. 29, 1992

[30] Foreign Application Priority Data

Jan. 4, 1992 [CN] China ..... 92100011

[51] Int. Cl.[5] ..... F25B 9/00

[52] U.S. Cl. ..... 62/6

[58] Field of Search ..... 62/6, 467; 60/520

[56] References Cited

U.S. PATENT DOCUMENTS 3,526,099 9/1970 Pavlin et al. ..... 62/6
3,817,044 6/1974 Daniels ..... 62/6
4,845,953 7/1989 Misawa ..... 62/6

*Primary Examiner*—Ronald C. Capossela

*Attorney, Agent, or Firm*—Charles E. Miller

[57] ABSTRACT

A multi-bypass pulse tube refrigerator comprising a pressure wave generator, a regenerator, a heat exchanger of cold ends (cold finger), a pulse tube, an orifice means and a reservoir volume, connecting in serial. Matrix material made of material of high heat capacity is packed in the regenerator. Rectifying means are arranged at the ends of the pulse tube. The outlet of the pressure wave generator is connected with the hot end of the regenerator. The connection between the cold ends of the regenerator and the pulse tube forms the heat exchanger of cold ends. The reservoir volume is connected with the hot end of the pulse tube through the orifice means. Resistance means are properly arranged in the pulse tube, so as to for gas to pass through the pulse tube uniformly and smoothly. At least one bypass with a throttling means is provided to connect the regenerator and the pulse tube. The refrigerator provided by the invention has a lower refrigeration temperature, high refrigeration capacity and improved refrigeration efficiency.

29 Claims, 6 Drawing Sheets

MULTI-BYPASS PULSE TUBE REFRIGERATOR

The present invention relates to a cryogenic refrigerator, and particularly to a pulse tube refrigerator employing a thin wall tube (known as a pulse tube) with rectifying members (the members to laminate gas flow) at its ends, through which gas is moved back and forth. In the tube, layers of gas are compressed, expand and pass in and out alternately and continuously. The temperature of the gas rises when compressed and drops when expanding, which brings about a considerable temperature gradient along the axis of the pulse tube and therefore forms a refrigerator. The pulse tube refrigerator according to the present invention includes a pressure wave generator, a regenerator, a heat exchanger of cold ends (cold finger), a pulse tube, throttling members and a reservoir volume, connecting in series. Both the regenerator and the pulse tube have heat exchangers at their hot ends opposing to the cold finger. Moreover bypasses with throttling members are provided between the middle portions of the regenerator and the pulse tube, and a plurality of layers of screen are axially packed in parallel inside the refrigerator.

BACKGROUND OF THE INVENTION

In 1963, Gifford et. al invented the first tube pulse refrigerator, known as basic type (U.S. Pat. No. 3,237,421). In 1984, Mikulin et. al provides an improved pulse tube refrigerator (USSR Patent No. SU553414) with a reservoir volume and an orifice member between the reservoir volume and the pulse tube. This refrigerator achieves a great improvement in performance and show its great potential of application on cryogenic circumstance.

A double-inlet pulse tube refrigerator is disclosed in Chinese Patent No. CN 89214250.2 by S. Zhu et. al, as shown in FIG. 1. The refrigerator includes a pressure wave generator 1, a regenerator 2, a heat exchanger of cold ends (cold finger) 3, a pulse tube 5, a throttling member 8 and a reservoir volume 9, connecting in serial. The regenerator 2 connects with the pressure wave generator at its hot end 2'. The cold end 2'' of the regenerator 2 is connected with the cold end 5'' of the pulse tube 5 by the heat exchanger 3. The reservoir volume 9 is connected with the hot end 5' of the pulse tube through the throttling member 8. Rectifying members 4 and 6 are arranged at the ends of the pulse tube 5. Screen is packed in the regenerator 2. Devices 7 and 10 may be provided near the hot ends 2', 5' and the cold finger 3 to strengthen heat transfer. Moreover, at the outlet of the pressure wave generator 1, a gas flow is diverted and enters the pulse tube 5 at its hot end 5' through a tube 12 with a throttling member 11. However the refrigerator has a limited maximum refrigeration capacity and minimum refrigeration temperature, although its refrigeration efficiency has been improved somewhat, resulting from the rigidity of the driven gas column (supposed as a gas piston in shape of the driven gas column) is less than that of the driven solid piston used in other cryocooler. Thus the effect of the refrigerator is not satisfied.

Accordingly, the object of the present invention is to provide a multi-bypass pulse tube refrigerator with improved refrigeration efficiency, much lower refrigeration temperature and increased refrigeration capacity.

SUMMARY OF THE INVENTION

To this end, the present invention provides a multi-bypass pulse tube refrigerator. The refrigerator includes a pressure wave generator, a regenerator, a heat exchanger of cold ends (cold finger), a pulse tube, orifice means and a reservoir volume, connecting in serial. Rectifying means are arranged at the ends of the pulse tube respectively. The rectifying means have a configuration of cylinder with axially parallel passages, and the outer diameter thereof is correspondent to the inner diameter of the pulse tube. Also, the rectifying means many be layers of screen axially packed, Matrix material made of material of high heat capacity, such as layers of screen and small balls, is packed inside the refrigerator. The outlet of the pressure wave generator is connected with the hot end of the regenerator. The cold end of the regenerator is connected with the cold end of the pulse tube through the heat exchanger of cold ends. The reservoir volume connects with the hot end of the pulse tube through an orifice means.

Resistance means, such as layers of screen axially packed, are properly arranged in the pulse tube so as for gas to pass the pulse tube smoothly and uniformly.

At the proper places of the regenerator and the pulse tube, the regenerator and the pulse tube are connected by a throttling means. That is, one or more gas flows are bypassed from the middle portion of the regenerator, and carried in and out of middle portions of the pulse tube by means of the control of the throttling means.

Preferably, the resistance means in the pulse tube are arranged at the two sides of the entrances where the side gas passes in and out of the pulse tube.

Preferably, the pressure wave generator is a common single piston reciprocating compressor with input and output valves removed (valveless compressor).

Alternatively, the pressure wave generator is a low and high pressure gas source with gas distributing means.

Preferably, the regenerator and the pulse tube are straight tubes with thin walls.

Alternatively, the regenerator and the pulse tube are curved or coil tubes with thin walls in similar shape.

Preferably, the shape of the cross sections of the regenerator and the pulse tube are is in circular, rectangular or triangle shape.

Preferably, the regenerator and the pulse tube are made of metal tubes or nonmetal tubes.

The regenerator and the pulse tube are arranged coaxially or not coaxially. When arranged coaxially, one of the regenerator and the pulse tube is placed inside the other, at least one orifice is formed in the wall of the inner one to control the side flow between the regenerator and the pulse tube, or the inner one is made of the porous material to form bypasses between the regenerator and the pulse tube.

Alternatively, when the regenerator and the pulse tube is not arranged coaxially, a capillary tube is provided to connect the regenerator and the pulse tube such that its ends respectively extend into the regenerator and the pulse tube from their hot ends.

Preferably, the medium in the refrigerator is gas, such as air, helium, nitrogen and mixture of gases; or gas-liquid biphase material, such as carbon dioxide; or liquid, such as ethyl alcohol and ether.

Further objects and advantages of the invention will appear from the following description taken together with the accompanying drawings.

THE DETAILED DESCRIPTION OF THE PREFERRED EMBODIMENTS

Figure 1:
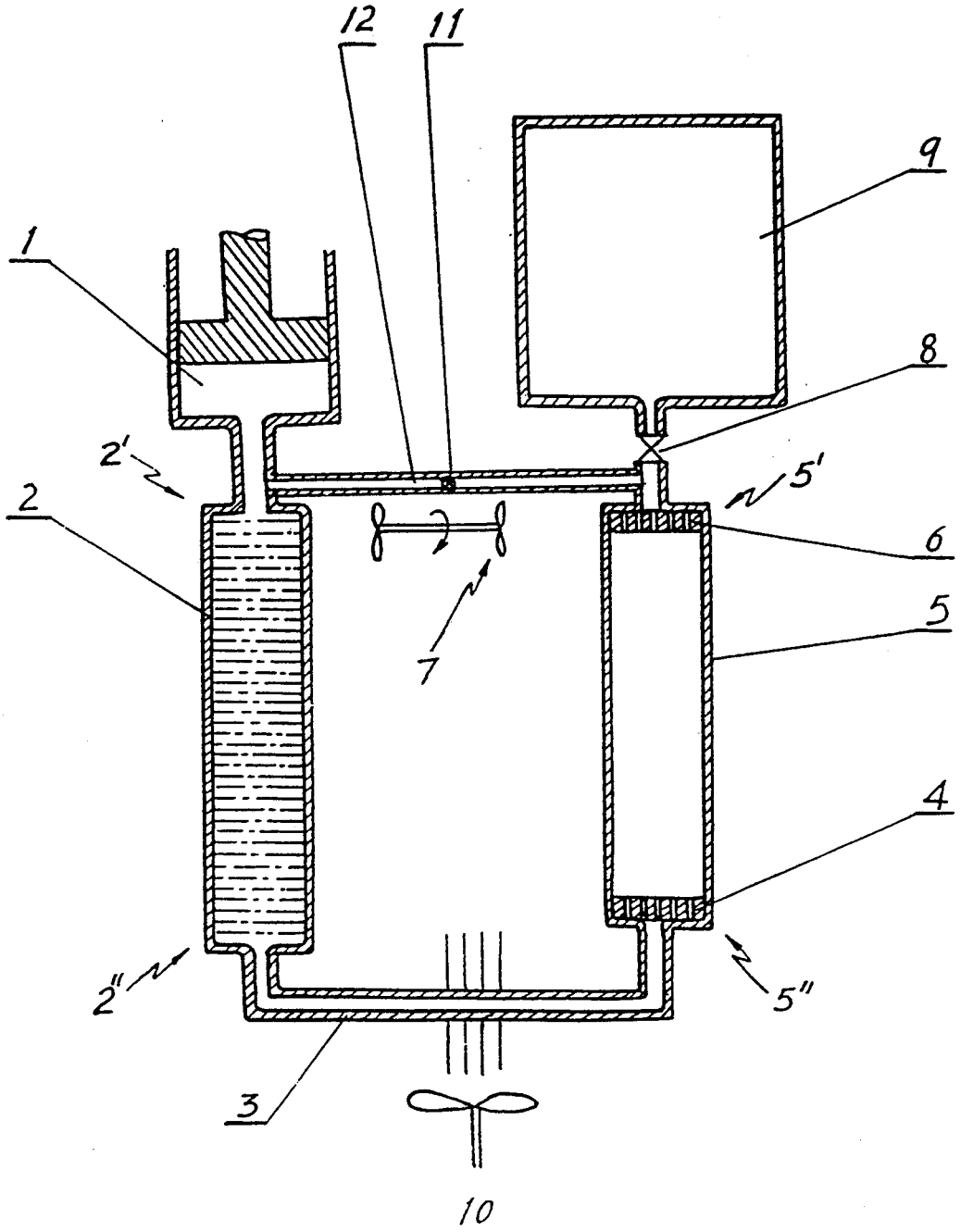
FIG. 1 Prior Art
FIG. 1 is a schematic view of a known double-inlet pulse tube refrigerator.
Figure 2:
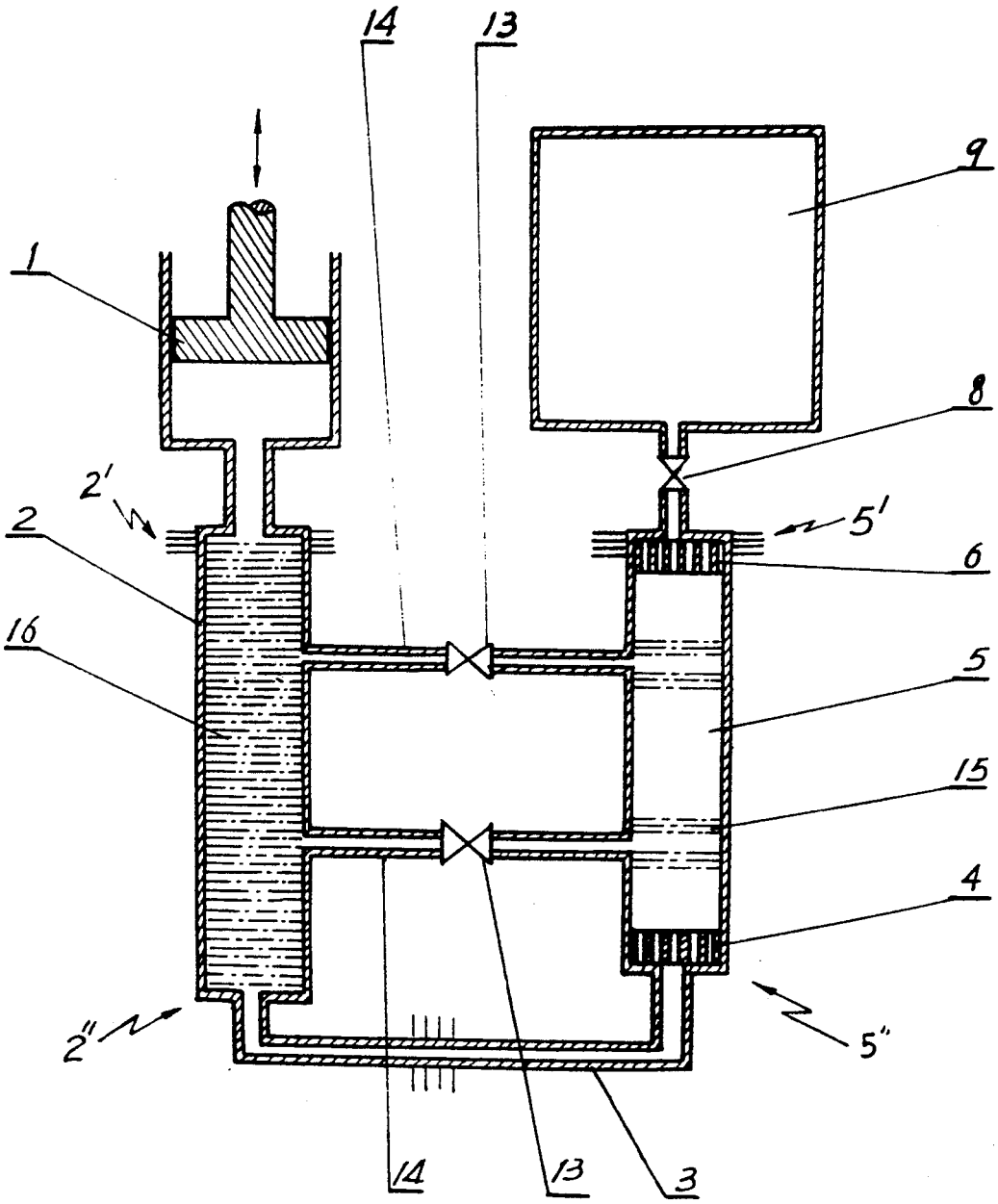
FIG. 2 is a schematic sectional view of the multi-bypass pulse tube refrigerator according to the first embodiment of the invention, in which the refrigerator and the pulse tube are arranged in U-shaped.

FIG. 2 shows a multi-bypass pulse tube refrigerator according to the first embodiment of the invention, in which a regenerator and a pulse tube are arranged in U-shaped. The refrigerator includes a pressure wave generator 1, a regenerator 2, a heat exchanger of cold ends (cold finger) 3, a pulse tube 5, a throttling member 8 and a reservoir volume 9, which are connected in serial. The pressure wave generator 1 is a common single piston compressor in which the input and output valves are removed. The single piston of the compressor reiterates under the action of a cam and a supporting spring (not shown) to generate pulsed pressure wave. The regenerator 2 is a straight tube with screen or matrix material 16 axially packed. The regenerator 2 also has a hot end 2', which is provided with radiators for heat rejecting and a cold end 2", which is connected with the cold end 5" of the pulse tube 5 through the heat exchanger 3. The cold finger 3 may be provided with radiators too. Rectifying members 4, 6 with axial through passages have a configuration of cylinder and are fit at the ends of the pulse tube 5 respectively, and have a outer diameter correspondent to the inner diameter of the pulse tube 5. The pulse tube 5 connects with the reservoir volume 9 at its hot end 5' through the throttling member 8. The hot end 5' is also provided with radiators for heat rejecting.

Two bypasses 14 with throttling members 13 are provided between the middle portions of the regenerator 2 and the pulse tube 5, and connect the regenerator 2 with the pulse tube 5. Entrances are formed on the inner surface of the pulse tube 5 where the bypasses join the pulse tube 5. A plurality of layers of screen 15 are provided in the pulse tube 5 and packed axially at the upper and lower sides of the entrances. The throttling member 13 may be a throttle or an adjustable throttling member with an orifice. Preferably, the regenerator 2 and the pulse tube is made of stainless steel tube with a outer diameter of 15–20 mm, wall thickness of 0.2–0.3 mm and length of 200–300 mm. The pulse tube refrigerator with above structure can achieve a lowest temperature of 72k as comparison with a known pulse tube refrigerator which reaches a lowest temperature of 91K.

Figure 3:
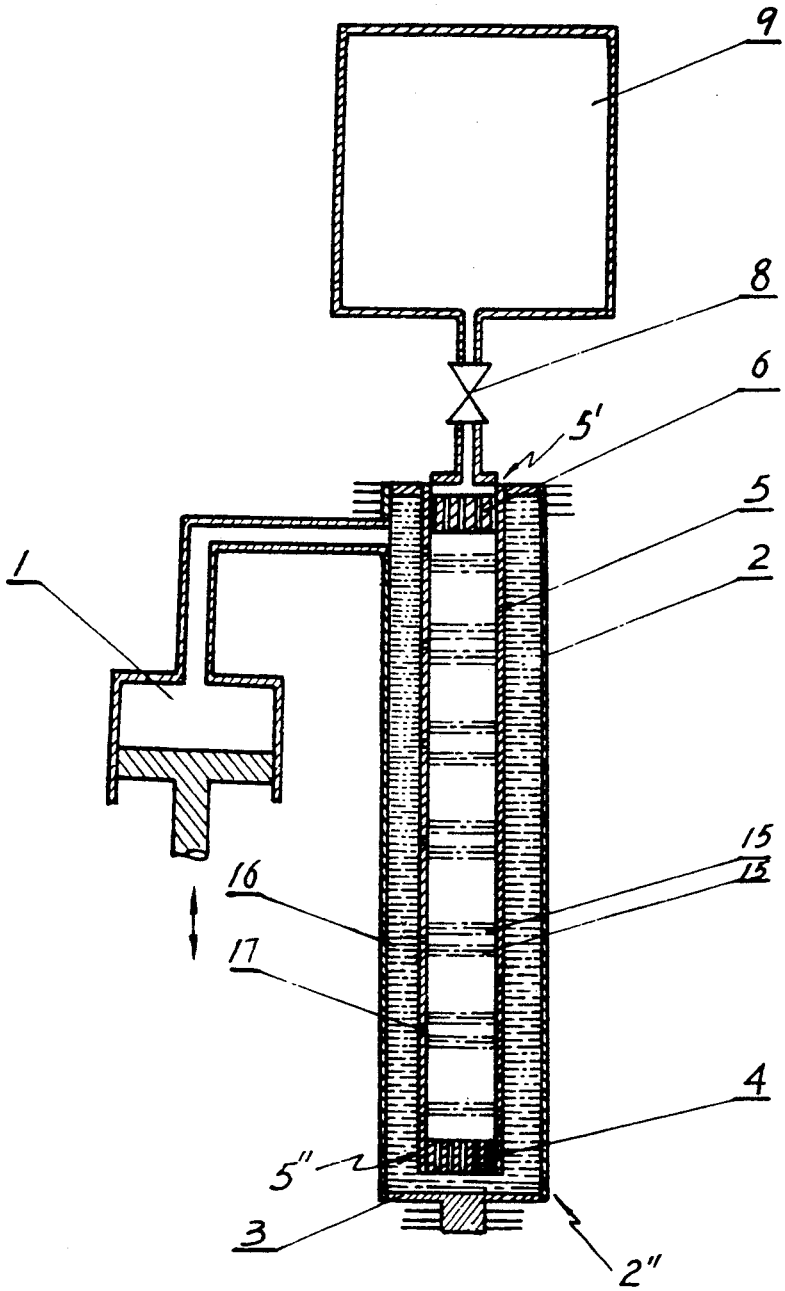
FIG. 3 is a schematic sectional view of the multi-bypass pulse tube refrigerator according to the second embodiment of the invention, in which the regenerator and the pulse tube is arranged co-axially.

The FIG. 3 shows the second embodiment of the present invention. The difference of the embodiment from the first one is in that the refrigerator in this embodiment has a coaxial arrangement of the regenerator 2 and the pulse tube 5. That is, in this embodiment the pulse tube 5 is coaxially arranged in the regenerator 2 and the annular area formed between the hot end 2' and 5' is enclosed. Radiators are also provided at the outside of the hot end 2' for heat rejecting. The cold end 2" of the regenerator is sealed and a projection with radiators extends from the terminal of the sealed cold end 2" for heat transfer (to be a heat exchanger of cold ends). A space is provided between the cold end 2" of the regenerator 2 and the cold end 5" of the pulse tube 5 to ensure communication of the regenerator 2 and the pulse tube 5. The pulse tube 5 is connected with the reservoir volume 9 through the throttling member 8 at the hot end 5'. The gas from the compressor 1 first enter the annular volume formed between the inner surface of the regenerator 2 and the outer surface of the pulse tube 5 and is then admitted into the pulse tube 5 from the cold end 5". Then the gas entering the pulse tube 5 can leave the pulse tube 5 at the hot end 5' and reach the reservoir volume 9 through the throttling member 8. Reversely, the gas in the reservoir volume can return the pulse tube 5 at the hot end 5' through the throttling member 8, and at the cold end 5" leave the pulse tube and reenter the regenerator 2.

As shown in FIG. 3, seven orifices are formed in the wall of the pulse tube 5 to substantially provide seven bypasses between the regenerator 2 and the pulse tube 5. A plurality of layers of screen are provided in the pulse tube and pack axially at the upper and lower sides of the entrances where the orifices join the inner surface of the pulse tube. Preferably, the orifices have a diameter of 0.05 mm–2.00 mm.

The pulse tube 5 may be alternatively made of porous material, in which micro passages form the bypasses to connect the regenerator 2 and the pulse tube 5.

Figure 4:
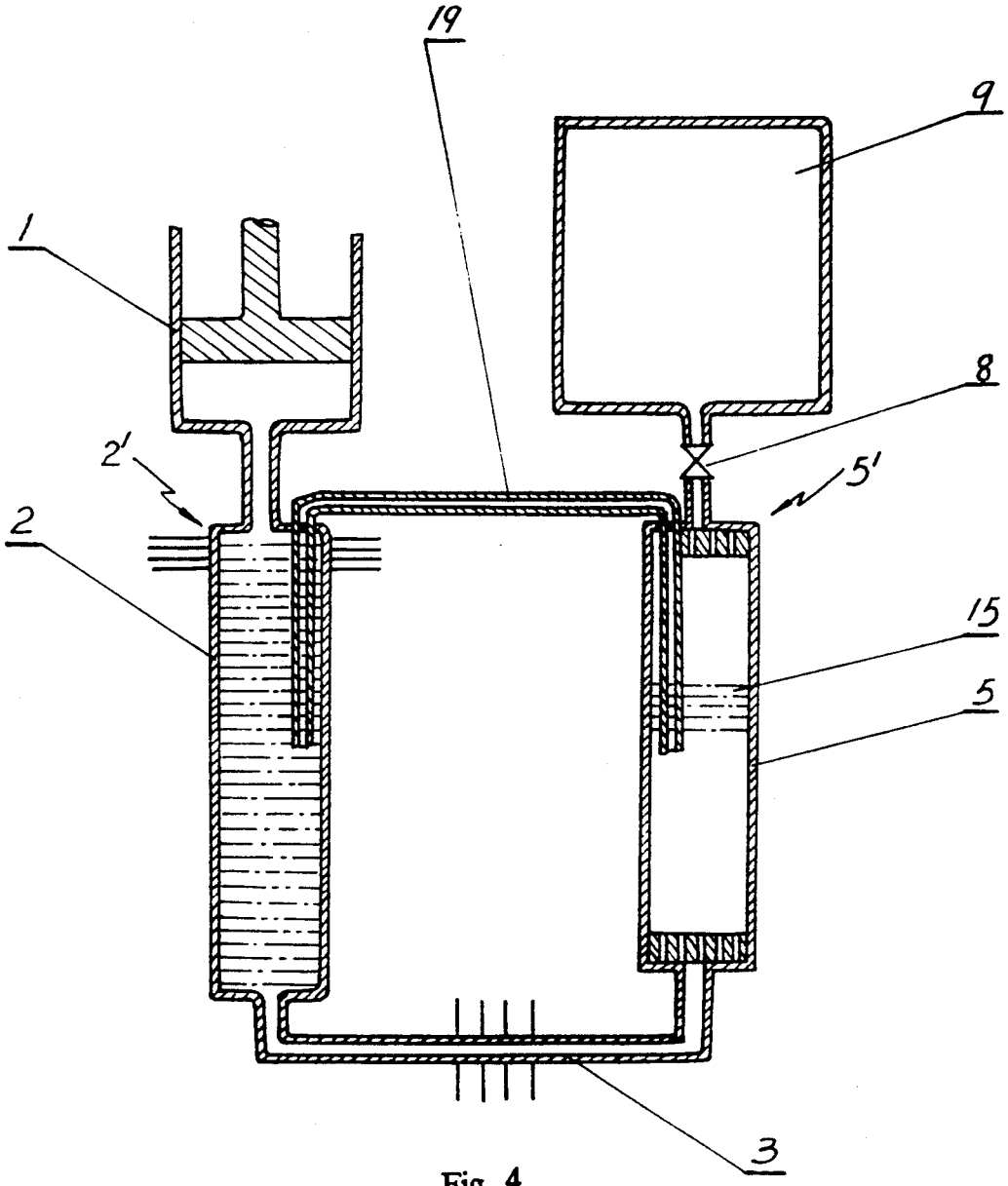
FIG. 4 is a schematic sectional view of the multi-bypass pulse tube refrigerator according to the third embodiment of the invention, in which the bypass is a capillary tube.

FIG. 4 shows the third embodiment of the present invention. the structure of the refrigerator in this embodiment is generally same as that in the first embodiment except two bypasses. Tens of layers of screen is packed axially in the pulse tube 5, and space the hot end 5' at a distance of one third of the length of the pulse tube 5. A capillary tube 9 connects the regenerator 2 with the pulse tube 5 in such a manner that its ends are respectively inserted into the regenerator 2 and the pulse tube 5 and respectively extend a distance of one third of the lengths of the regenerator 2 and the pulse tube 5 from the hot ends 2' and 5'. The capillary tube 9 forms the bypass to communicate the regenerator 2 and the pulse tube 5.

Figures 5A, 5B:
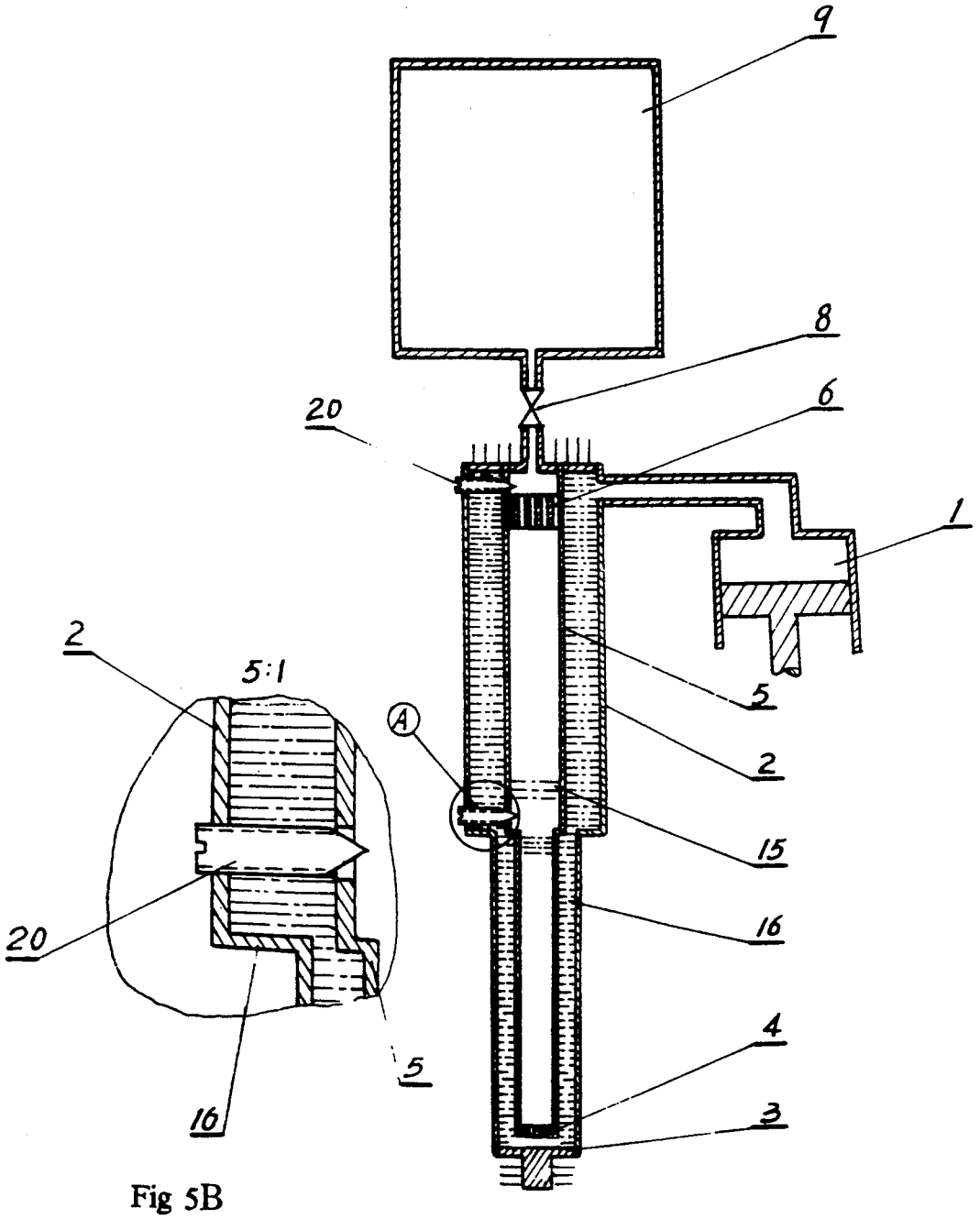
FIG. 5A is a schematic sectional view of the multi-bypass pulse tube refrigerator according to the fourth embodiment of the invention, in which the bypasses is constituted of adjustable needle valves and orifices.
FIG. 5B is an enlarged view, showing A area of FIG. 5B.

FIGS. 5A and 5B show the fourth embodiment of the present invention. As in the second embodiment, the pulse tube 5 is coaxially arranged in the regenerator 2.

Two orifices are formed in the wall of the pulse tube 5 and adjustable needle valves are fit therein. Both the regenerator 2 and the pulse tube 5 include two portions with different diameters and are made of stainless steel tube. Preferably, the thin portion of the regenerator 2 has a outer diameter of 7.3 mm and wall thickness of 0.15 mm, and the thick portion thereof has a outer diameter of 9.4 mm and wall thickness of 0.2 mm. The correspondent thin portion of the regenerator 2 has a outer diameter of 14.3 mm and wall thickness of 0.15 mm, and the correspondent thick portion thereof has a outer diameter of 19.6 mm and wall thickness of 0.3 mm. The resistance member 15 is 80–250 mesh red copper screen. The reservoir volume has a volume of 150 cc–250 cc. The pressure wave generator/compressor 1 has a displacement of 68 cc. The present refrigerator can achieve a lowest temperature of 31K while the known one just reach a lowest temperature of 106K.

The medium in the refrigerator may be gas, such as air, helium, nitrogen and mixture of gases; or gas-liquid biphase material, such as carbon dioxide; or liquid, such as ethyl alcohol and ether.

The refrigerator provided by the invention can be manufactured in various shapes and sizes to adapt different work spaces.

Figure 6A:
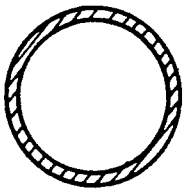
FIGS. 6A, 6B and 6C show the shapes of the cross sections of the regenerator and the pulse tube.
Figure 6B:
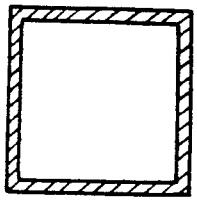
Figure 6C:
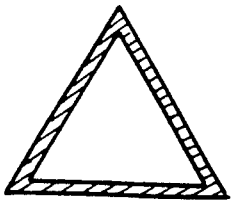

FIGS. 6A, 6B and 6C show several shapes of the cross sections of the regenerator and the pulse tube. The pulse tube and the regenerator can be manufactured in circular, rectangular, or triangle shape.

Figure 7A:
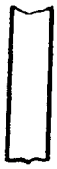
FIGS. 7A, 7B and 7C are schematic views, showing the regenerator and the pulse tube may be in straight, curved or coil shape.
Figure 7B:
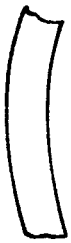
Figure 7C:
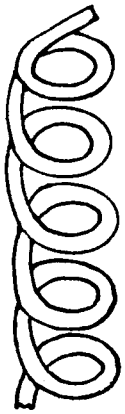

FIGS. 7A, 7B and 7C show that the regenerator and the pulse tube can be made into straight, curved or coil shape.

While the description of the invention has been given with respect to above preferred embodiments, it is not to be constructed in a limited sense. Variation and modification will occur to those skilled in the art. Reference is made to the appended claims for a definition of the invention.

What is claimed is:

1. A multi-bypass pulse tube refrigerator comprising a pressure wave generator, a regenerator, a heat exchanger of cold ends (cold finger), a pulse tube, an orifice means and a reservoir volume, connecting in serial; matrix material made of material of high heat capacity is packed in the regenerator; rectifying means are arranged at the ends of the pulse tube; the outlet of the pressure wave generator is connected with the hot end of the regenerator; the connection between the cold ends of the regenerator and the pulse tube forms the heat exchanger of cold ends; the reservoir volume is connected with the hot end of the pulse tube through the orifice means; wherein, resistance means are properly arranged in the pulse tube, so as to for gas to pass through the pulse tube uniformly and smoothly;

at least one bypass with a throttling means is provided to connect the regenerator and the pulse tube at the middle portions of the regenerator and the pulse tube.

2. A multi-bypass pulse tube refrigerator according to claim 1, wherein, the resistance means in the pulse tube are arranged at the upper and lower sides of the entrance where a bypass joins the pulse tube.

3. A multi-bypass pulse tube refrigerator according to claims 1 or 2, wherein the resistance means in the pulse tube are made of porous material.

4. A multi-bypass pulse tube refrigerator according to claim 3, wherein, the porous material is screen.

5. A multi-bypass pulse tube refrigerator according to claim 4, wherein the throttling means in the bypasses are valves.

6. A multi-bypass pulse tube refrigerator according to claim 4, wherein the throttling means in the bypasses are orifice means.

7. A multi-bypass pulse tube refrigerator according to claim 4, wherein the throttling means in the bypasses are capillary means.

8. A multi-bypass pulse tube refrigerator according to claims 1 or 2, wherein the throttling means in the bypasses are valves.

9. A multi-bypass pulse tube refrigerator according to claims 1 or 2, wherein the throttling means in the bypasses are orifice means.

10. A multi-bypass pulse tube refrigerator according to claims 1 or 2, wherein the throttling means in the bypasses are capillary tubes.

11. A multi-bypass pulse tube refrigerator according to claims 1 or 2, wherein, the regenerator and the pulse tube are arranged coaxially.

12. A multi-bypass pulse tube refrigerator according to claim 11, wherein, the pulse tube is co-axially arranged in the regenerator and at least one orifice is formed in the wall of the regenerator.

13. A multi-bypass pulse tube refrigerator according to claim 12, wherein, the regenerator is made of porous material.

14. A multi-bypass pulse tube refrigerator according to claim 11, wherein, the pulse tube is co-axially arranged in the regenerator and at least one orifice is formed in the wall of the pulse tube.

15. A multi-bypass pulse tube refrigerator according to claim 14, wherein, the pulse tube is made of porous material.

16. A multi-bypass pulse tube refrigerator comprising a pressure wave generator, a regenerator, a heat exchanger of cold ends (cold finger), a pulse tube, an orifice means and a reservoir volume, connecting in serial; matrix material made of material of high heat capacity is packed in the regenerator; rectifying means are arranged at the ends of the pulse tube; the outlet of the pressure wave generator is connected with the hot end of the regenerator; the connection between the cold ends of the regenerator and the pulse tube forms the heat exchanger of cold ends; the reservoir volume is connected with the hot end of the pulse tube through the orifice means; wherein, resistance means are properly arranged in the pulse tube, so as to for gas to pass through the pulse tube uniformly and smoothly;

a capillary tube is provided between the regenerator and the pulse tube and connect therebetween to form a bypass; the ends of the capillary tube respectively inserted in the regenerator and the pulse tube at their hot ends, and extend therein.

17. A multi-bypass pulse tube refrigerator according to claims 1 or 2 or 16, wherein, the pressure wave generator is a single piston compressor with the input and output valves removed.

18. A multi-bypass pulse tube refrigerator according to claims 1 or 2 or 16, wherein, the pressure wave generator is a low and high pressure gas source with gas distributing means.

19. A multi-bypass pulse tube refrigerator according to claims 1 or 2 or 16, wherein, the regenerator and the pulse tube are metal tubes with thin walls.

20. A multi-bypass pulse tube refrigerator according to claims 1 or 2 or 16, wherein, the regenerator and the pulse tube are nonmetal tubes with thin walls.

21. A multi-bypass pulse tube refrigerator according to claims 1 or 2 or 16, wherein, the regenerator and the pulse tube have a cross section of circular shape.

22. A multi-bypass pulse tube refrigerator according to claims 1 or 2 or 16, wherein, the regenerator and the pulse tube have a cross section of rectangular shape.

23. A multi-bypass pulse tube refrigerator according to claims 1 or 2 or 16, wherein, the regenerator and the pulse tube have a cross section of triangle shape.

24. A multi-bypass pulse tube refrigerator according to claims 1 or 2 or 16, wherein, the axes of the regenerator and the pulse tube are straight lines.

25. A multi-bypass pulse tube refrigerator according to claims 1 or 2 or 16, wherein, the axes of the regenerator and the pulse tube are curved lines in similar shape.

26. A multi-bypass pulse tube refrigerator according to claims 1 or 2 or 16, wherein, the axes of the regenerator and the pulse tube are coil lines in similar shape.

27. A multi-bypass pulse tube refrigerator according to claims 1 or 2 or 16, wherein, the medium in the refrigerator is gas.

28. A multi-bypass pulse tube refrigerator according to claims 1 or 2 or 16, wherein, the medium in the refrigerator is gas-liquid biphase material.

29. A multi-bypass pulse tube refrigerator according to claims 1 or 2 or 16, wherein, the medium in the refrigerator is liquid.

* * * * *